US009314072B2

(12) United States Patent
Lee et al.

(10) Patent No.: US 9,314,072 B2
(45) Date of Patent: Apr. 19, 2016

(54) REVERSIBLE PIN PLATE FOR FINE WRIST STRAP ADJUSTMENT

(71) Applicant: Salutron, Inc., Fremont, CA (US)

(72) Inventors: Yong Jin Lee, Palo Alto, CA (US); Robert McClain, Fremont, CA (US)

(73) Assignee: Salutron, Inc., Fremont, CA (US)

( * ) Notice: Subject to any disclaimer, the term of this patent is extended or adjusted under 35 U.S.C. 154(b) by 0 days.

(21) Appl. No.: 13/756,269

(22) Filed: Jan. 31, 2013

(65) Prior Publication Data

US 2014/0208546 A1 Jul. 31, 2014

(51) Int. Cl.

| | |
|---|---|
| ***A44C 5/14*** | (2006.01) |
| ***A44C 5/20*** | (2006.01) |
| ***A44B 11/24*** | (2006.01) |

(52) U.S. Cl.

CPC ..... *A44C 5/2023* (2013.01); *A44B 11/24* (2013.01); *Y10T 24/1368* (2015.01); *Y10T 24/4782* (2015.01)

(58) Field of Classification Search

CPC ..... A44C 5/14; A44C 5/2071

USPC ..... 224/164, 165, 176; 24/174, 176, 177, 24/265 R, 265 WS

See application file for complete search history.

(56) References Cited

U.S. PATENT DOCUMENTS

| | | | | |
|---|---|---|---|---|
| 2,641,812 | A * | 6/1953 | Boudreau | 24/176 |
| 5,226,809 | A * | 7/1993 | Franco | 24/704.1 |
| 8,088,043 | B2 * | 1/2012 | Andren et al. | 482/8 |

* cited by examiner

*Primary Examiner* — Adam Waggenspack

(74) *Attorney, Agent, or Firm* — Vierra Magen Marcus LLP

(57) ABSTRACT

A device is disclosed for wearing on a wrist or other body part including a central piece held on the body part by a pair of straps. A first strap includes fastening holes and the second strap includes a pin plate having pins for mating within the fastening holes in the first strap to affix the device to the body part. The pins are off-center with respect to a lengthwise centerline dividing a width of the pin plate in half. The pin plate may be affixed to the second strap into different orientations, to thereby allow adjustment of a fit of the device to the body part with finer granularity than provided by the pitch of the fastening holes in the first strap.

9 Claims, 6 Drawing Sheets

REVERSIBLE PIN PLATE FOR FINE WRIST STRAP ADJUSTMENT

BACKGROUND

Activity monitors have become popular as a tool for promoting exercise and a healthy lifestyle. In addition to keeping time, an activity monitor can include a wide variety of devices for providing biometric information, such as for example a pulse monitor for monitoring heart rate, and an accelerometer which can measure motions such as steps taken while walking or running to provide an estimate of an amount of calories used. Moreover, user-specific information such as age, gender, height and weight can be used to tailor the estimate to the user. Such monitors can be worn on the wrist or arm, for instance. The monitor can be worn during an intended workout period or as a general, all day, free living monitor, where the user may perform specific exercises at some times while going about their daily activities at other times, e.g., including sitting, standing and sleeping.

A typical monitor may be affixed to a wrist or arm with a pair of straps which fold around the wrist or arm, and then affix to each other with a clasp having mating portions on the respective straps. Often, a first strap will have holes along at least a portion of the length of the strap, and the second strap will have a pin which mates in one of the holes of the first strap. The straps may be adjusted for wrists and arms of different sizes by choosing to mate the pin within the appropriate hole along the length of the first strap.

For reasons including aesthetics and the tensile strength of the first strap, it may be desirable to space the holes at least a predetermined distance from each other along the first strap. While satisfying aesthetic and strength criteria, spacing the holes as such may have a disadvantage in that a user may find that placing the pin in a first hole results in the monitor being too large around the wrist or arm, while placing the pin in the next adjacent hole results in the monitor being too small around the wrist or arm.

SUMMARY

Embodiments of the present technology relate to a removable and reversible pin plate for fastening straps of a wrist-worn device around a wearer's wrist. A first strap includes pairs of fastening holes along a length of the strap. A second strap includes openings in an end of the strap for receiving the pin plate. A wearer can fasten the device around a wrist to a desired fit by mating pins of the pin plate within a pair of fastening holes on the first strap.

The fastening holes are spaced from each other a given distance along the length of the first strap. A wearer may desire a fit of the device which is not available with the given spacing of the fastening holes. That is, the device may be too loose if the pin plate is fastened in a first set of fastening holes, but too tight if fastened in the next adjacent set of fastening holes. In accordance with the present technology, the pins in the pin plate are off-center from a front edge to a back edge of the pin plate. By reversing a position of the pin plate in the second strap, the wearer is able to fit the device around a wrist at a size which is effectively between two adjacent sets of fastening holes. Thus, the present technology allows adjustment of a fit of the device to the wrist or other body part with finer granularity than provided by the pitch of the fastening holes in the first strap.

In an example, the present technology relates to a strap for a device wearable on a body part, the device including a central piece to which the strap is capable of connection, the strap comprising: a proximal end capable of being affixed to the central piece; and a pin plate removably affixed to the strap, the pin plate including a pin, the pin plate capable of being affixed to the second strap in a first orientation to define a first distance between the pin and the proximal end of the strap, and the pin plate capable of being affixed to the strap in a second orientation to define a second distance between the pin and the proximal end of the strap, the first and second distances being different from each other.

In a further example, the present technology relates to a device for wearing on a body part, the device comprising: a central piece; a first strap affixed to a first portion of the central piece, the first strap including a length and a plurality of fastening holes along the length; a second strap having a proximal end affixed to a second portion of the central piece; and a pin plate removably affixed to the second strap, the pin plate including a pin for mating within a fastening hole of the plurality of fastening holes on the first strap, the pin plate capable of being affixed to the second strap in a first orientation to define a first distance between the pin and the proximal end of the second strap, and the pin plate capable of being affixed to the second strap in a second orientation to define a second distance between the pin and the proximal end of the second strap, the first and second distances being different from each other.

In another example, the present technology relates to a device for wearing on a body part, the device comprising: a central piece; a first strap affixed to a first portion of the central piece, the first strap including a length and pairs of fastening holes along the length and centered about a widthwise centerline dividing the length of the first strap in half, two fastening holes adjacent to each other along the length of the first strap having a pitch between them; a second strap having a proximal end affixed to a second portion of the central piece; and a pin plate removably affixed to the second strap, the pin plate comprising: a lengthwise centerline dividing a width of the pin plate in half, a widthwise centerline dividing a width of the pin plate in half, a pair of pins, on opposite sides of the widthwise centerline and equidistant from the widthwise centerline, for mating within a pair of fastening holes of the pairs of fastening holes in the first strap, the pair of pins being off-center with respect to the lengthwise centerline such that the pin plate is capable of being affixed to the second strap in a first orientation to define a first distance between the pair of pins and the proximal end of the second strap, and the pin plate capable of being affixed to the second strap in a second orientation, rotated 180° from the first orientation, to define a second distance between the pair of pins and the proximal end of the second strap, the first and second distances being different from each other.

This summary is provided to introduce a selection of concepts in a simplified form that are further described below in the description. This summary is not intended to identify key features or essential features of the claimed subject matter, nor is it intended to be used as an aid in determining the scope of the claimed subject matter.

DETAILED DESCRIPTION

The present technology will now be described with reference to FIGS. 1 through 10, which in embodiments, relate to a reversible pin plate providing a fit of a worn device at a size between a pitch of adjacent fastening holes. It is understood that the present invention may be embodied in many different forms and should not be construed as being limited to the embodiments set forth herein. Rather, these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

The terms "top" and "bottom," "upper" and "lower," and "vertical" and "horizontal" and "front" and "back" as may be used herein are by way of example and illustrative purposes only, and are not meant to limit the description of the invention inasmuch as the referenced item can be exchanged in position and orientation. Also, as used herein, the terms "substantially" and/or "about" mean that the specified dimension or parameter may be varied within an acceptable manufacturing tolerance for a given application. In one embodiment, the acceptable manufacturing tolerance is ±0.25%.

Figure 1:
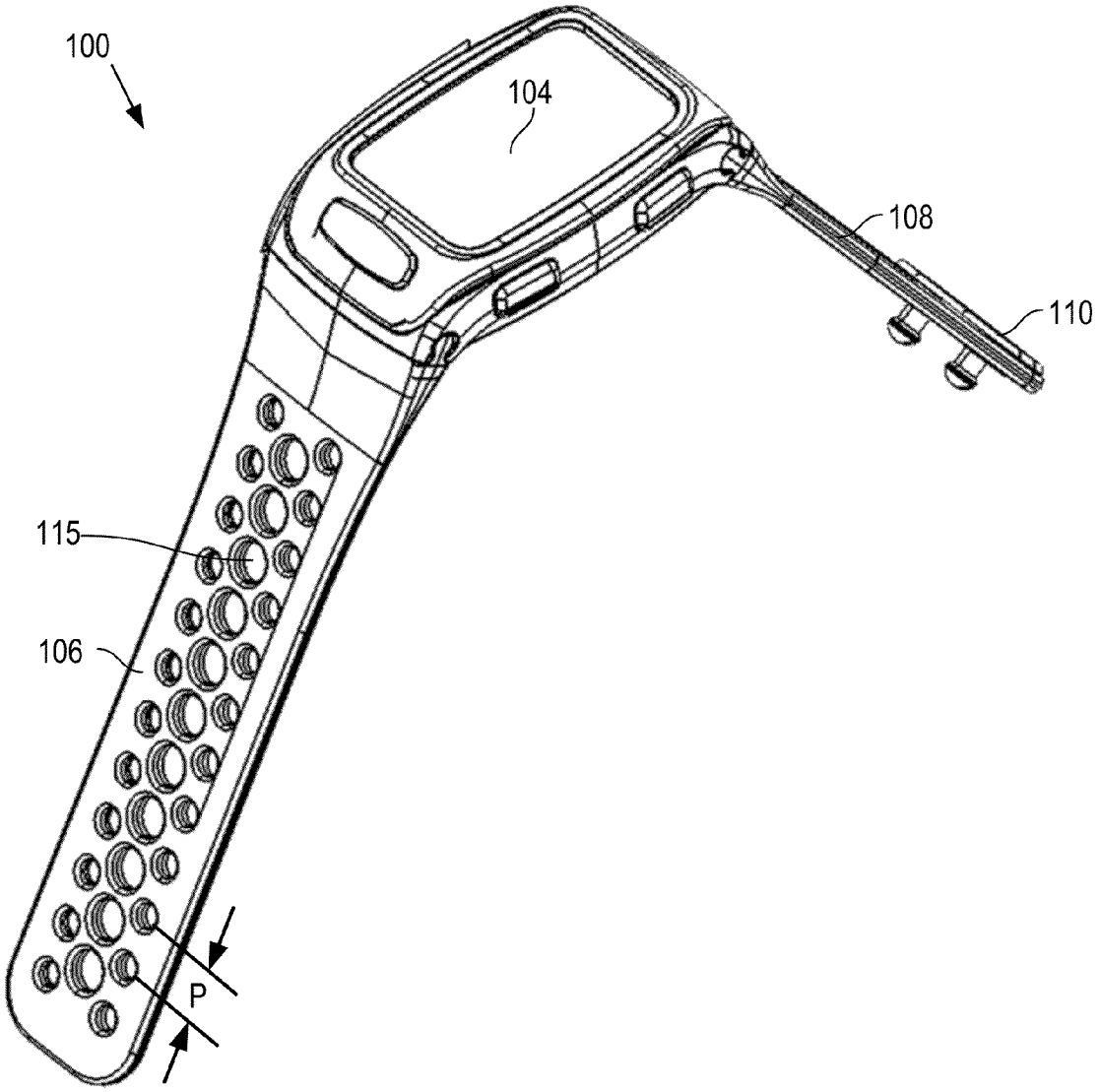
FIG. 1 is a perspective view of a device including a pin plate according to embodiments of the present technology.
Figure 2:
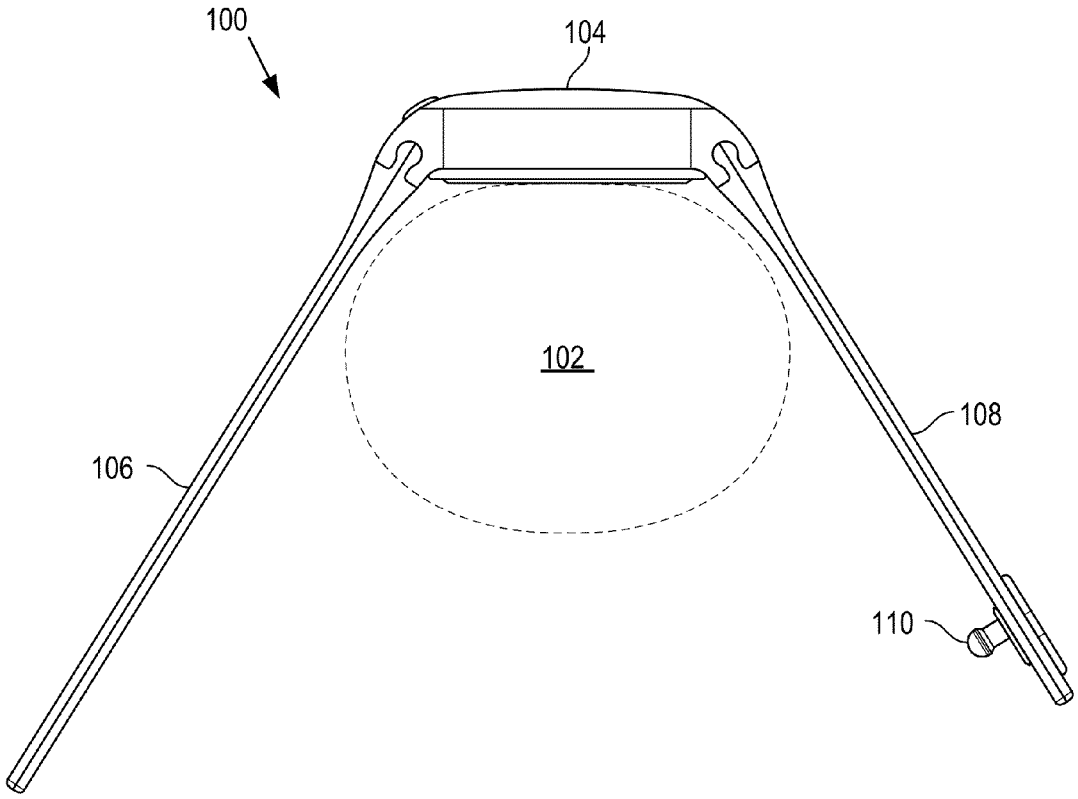
FIG. 2 is a side view of a device including a pin plate according to embodiments of the present technology.

Referring initially to the perspective and side views of FIGS. 1 and 2, there is shown a device 100 including a central piece 104 which may be affixed to a wrist 102 by affixing a first strap 106 to a second strap 108 around the wrist. The device 100 is described in the embodiments below as being affixed around a wrist of a wearer. However, it is understood that the device 100 may be affixed around other body parts in further embodiments, including for example an arm, ankle, leg, head or neck. Although not critical to embodiments of the present invention, central piece 104 may have a length of approximately 53 mm, a width of approximately 30 mm and a thickness of approximately 13 mm. Is understood that the length, width and/or thickness may be larger or smaller than that in further embodiments.

The type and function of central piece 104 are not critical to the operation of embodiments of the present invention, but may for example be any of various monitors such as a watch, timer, pulse monitor, pedometer or other accelerometer, calorie counter, smart phone, video phone, digital assistant, digital display and/or calculator. In further embodiments, central piece 104 need not be a monitor or functioning device. It may for example alternatively be part of a bracelet or jewelry provided for aesthetic value.

The straps 106 and 108 are formed of a variety of flexible material including for example polyurethane. As described below, straps 106 and 108 may be removable and reversible. That is, one or both straps 106, 108 may be removed from the central piece 104, flipped over and reattached to the central piece 104.

Strap 106 includes a number of pairs of fastening holes 114, with each pair being aligned with each other across the width of strap 106. It is conceivable that the fastening holes 114 in the respective pairs are not aligned with each other across the width of strap 106, in which case the pins of the pin plate (described below) would have a similar mis-alignment. In embodiments, the strap 106 may have a length of 105 mm, a width of 28 mm and a thickness of between 1 and 2 mm. Is understood that the length, width and/or thickness of strap 106 may be larger or smaller than that in further embodiments.

In embodiments, each pair of fastening holes 114 may be spaced from each other by a pitch, P. In embodiments, the pitch P may be 6.8 mm, though the pitch may be greater or lesser than that in further embodiments. Each fastening hole 114 in a given pair may be spaced from each other (across the width of the strap 106) a distance of 10.1 mm, though this spacing may be smaller or larger than that in further embodiments. Each fastening hole 114 in a given pair may also be equally spaced from a middle line halfway across the width, and extending along the length, of strap 106.

In embodiments, each fastening hole 114 may be circular and have a diameter of 3.1 mm, though the diameter may be larger or smaller than that in further embodiments. In further embodiments, the fastening holes 114 need not be circular, and may for example instead be oval or have 2, 3, 4 or more straight edges.

In embodiments described herein, strap 106 includes pairs of fastening holes 114 oriented across the width of strap 106 which receive pins of the pin plate to fasten the respective straps of device 100 together. However, in a further embodiment, there may be a single fastening hole instead of a pair of holes. In this embodiment, there would be a number of single holes spaced along the length of strap 106, each spaced apart from each other by the pitch, P. Such a fastening hole could be circular, oval or have straight edges as described above. In such an embodiment, there would be a single pin on the pin plate corresponding in shape and position (with respect to the width dimension of the straps).

Figure 7:
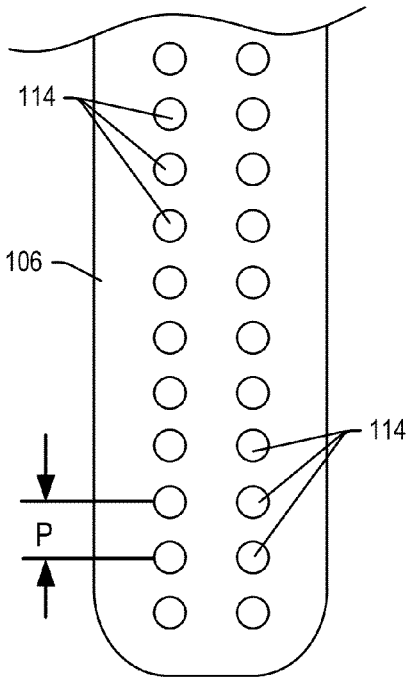
FIG. 7 is a top view of a first strap including pairs of fastening holes.

FIG. 1 shows additional holes 115 along the centerline of the strap 106. The holes 115 may be provided for example to increase the amount of air which gets to the wearer's skin through the strap 106 and/or for ornamentation. As shown in FIG. 7 described below, the holes 115 may be omitted from strap 106.

Figure 3:
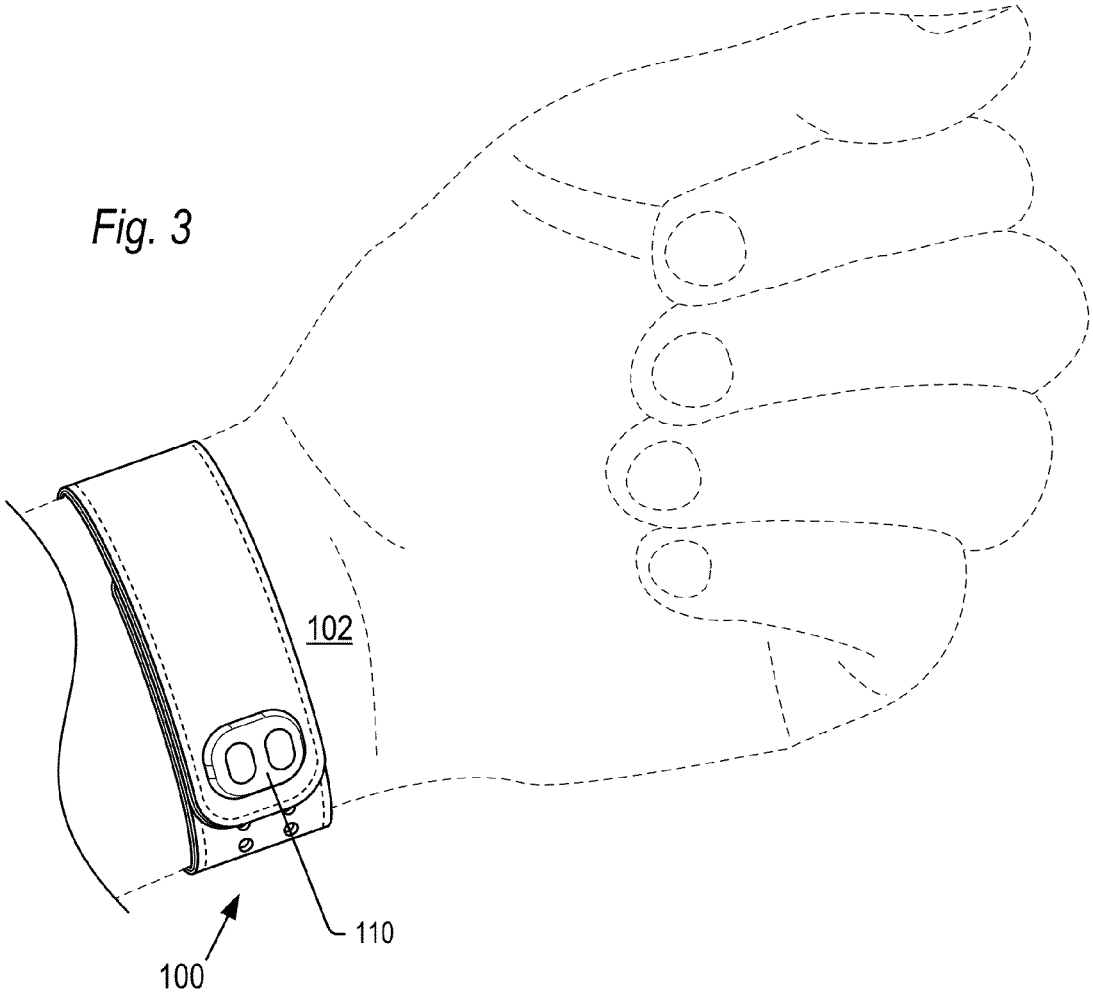
FIG. 3 is a perspective view of a device including a pin plate around a wrist of a wearer.
Figure 4:
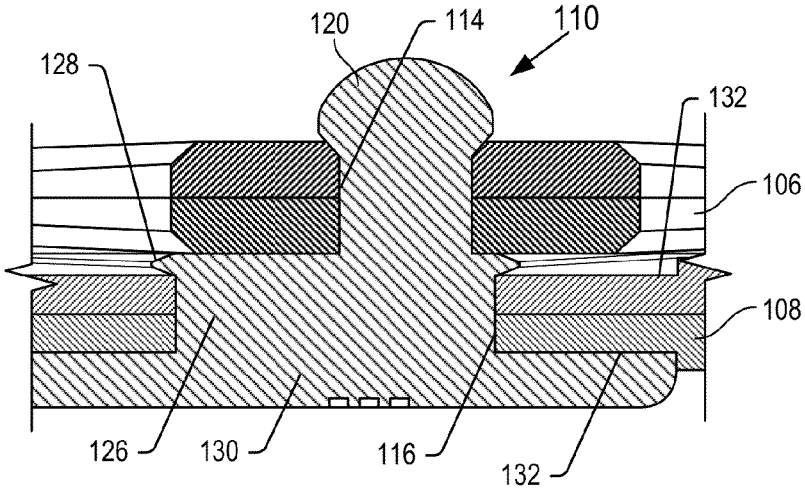
FIG. 4 is a cross-sectional view through a pin plate, and straps fastened together by the pin plate, according to embodiments of the present technology.

Strap 108 may be formed of the same material as strap 106, and with the same width and thickness as strap 106. In embodiments, strap 108 may have a length of 90.5 mm, though the length may be greater or lesser than this in further embodiments. The strap 108 may have no holes similar to fastening holes 114 and/or holes 115. However, strap 108 may include fastening holes 114 and/or holes 115 for aesthetics and/or to increase the amount of air which gets to the wearer's skin through the strap 108. Strap 108 may have a proximal end affixed to central piece 104, and a distal end opposite the proximal end. The strap 108 may include openings at its distal end for receiving the pin plate 110. As shown in FIGS. 3 and 4, when worn by a user, the pin plate may be removably affixed to strap 108 so that pins on the pin plate 110 extend through strap 106 (toward the skin of the user) to affix the device 100 to the wrist or other body part of the user. The pins of the pin plate are explained hereinafter, but in general may include a head which is rounded to avoid pressure points over a small contact area with the skin, and yet with sloped edges which allow them to be easily inserted through fastening holes 114.

Figure 5:
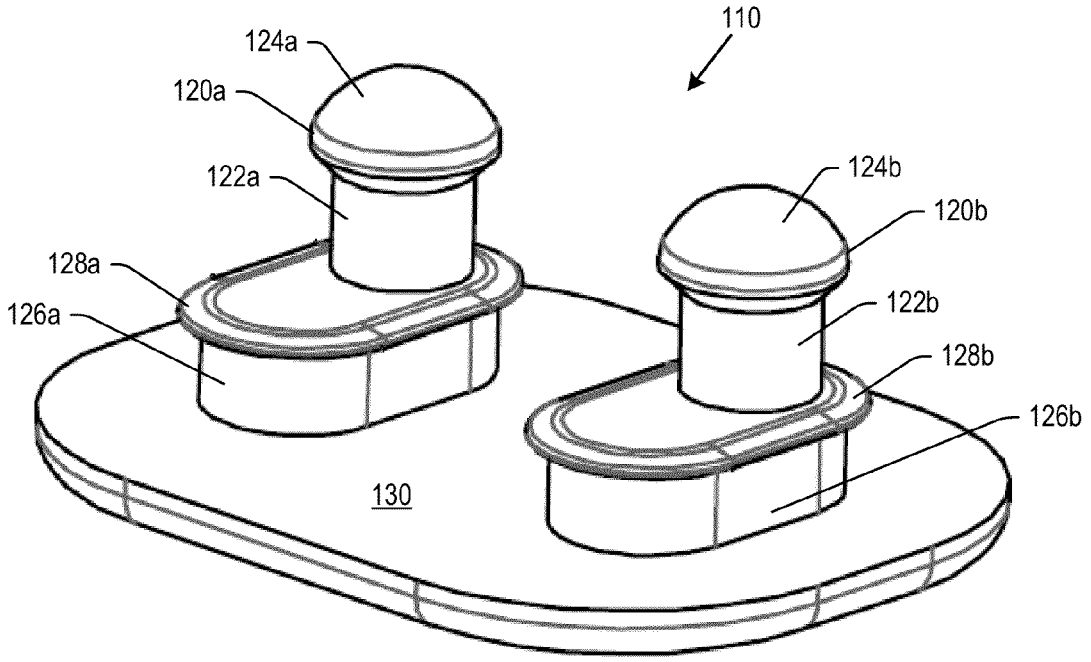
FIG. 5 is a perspective view of a pin plate according to embodiments of the present technology.
Figure 6:
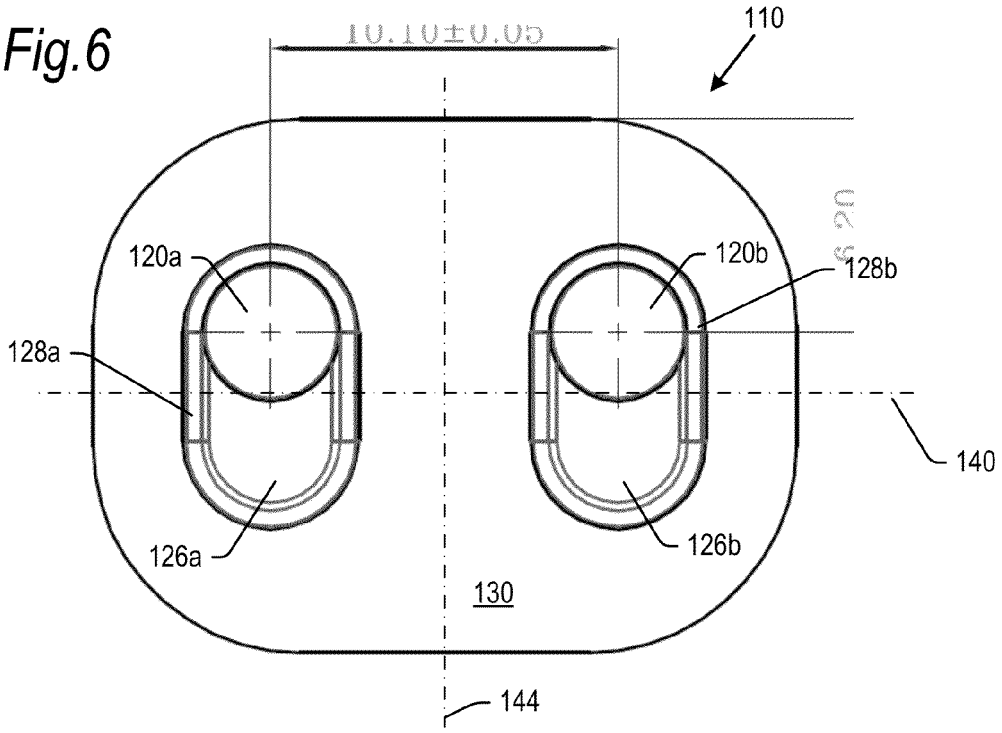
FIG. 6 is a top view of a pin plate according to embodiments of the present technology.

Details of embodiments of the pin plate 110 will now be explained with reference to the perspective and top views of FIGS. 5 and 6. In embodiments, pin plate 110 may include a base plate 130, and a pair of bosses 126*a*, 126*b* having a proximal end extending from the base plate 130 and a distal end terminating in a flange 128*a*, 128*b*. As explained below, the bosses 126 and flanges 128 are used to secure the pin plate 110 to the strap 108. The pin plate 110 may be formed of a rigid material such as for example various plastics, nylon and/or metal. Where formed of plastic or nylon, the pin plate 110 may for example be injection molded as a single piece. Where formed of metal, the pin plate 110 may for example be molded or welded together.

Pin plate 110 further includes pins 120*a* and 120*b* formed on top of bosses 126*a* and 126*b*, respectively. Pins 120*a*, 120*b* are comprised of shafts 122*a*, 122*b* having proximal ends extending from bosses 126*a*, 126*b*, and heads 124*a*, 124*b* on the distal ends of shafts 122. As explained below, the pins 120 are used to secure the strap 106 to the pin plate 110 and strap 108.

Figure 8:
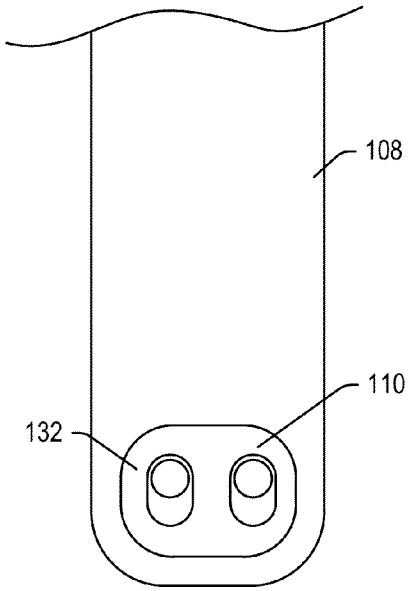
FIG. 8 is a top view of a second strap including a pin plate according to embodiments of the present technology.
Figure 9:
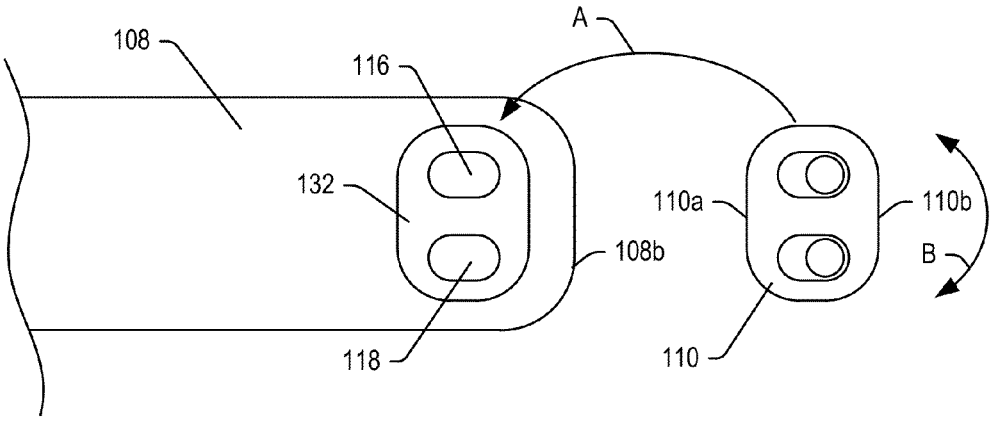
FIG. 9 is a top view of the second strap and pin plate separated from each other according to embodiments of the present technology.

FIG. 7 shows a top (or bottom) view of a portion of the strap 106, and FIG. 8 shows a top (or bottom) view of a portion of strap 108. In embodiments, a distal end of strap 108 may include a recess 132 on both the front and back surfaces of strap 108. As seen in FIG. 9, a pair of openings 116 are formed through strap 108 interiorly of recess 132. The openings 116 are positioned and sized so as to receive bosses 126 and flanges 128 therethrough. As shown in the cross-sectional view of FIG. 4, the pin plate 110 mates with the strap 108 with the base plate 130 residing in a recess 132 on one side of the strap 108, and the bosses 126 extending through openings 116 so that flanges 128 extend through the openings 116 to the opposite side of strap 108. This secures the pin plate 110 to the strap 108.

In embodiments, the bosses 126 and openings 116 are shown with an oval shape. It is understood that the bosses 126, flanges 128 and openings 116 may have other shapes in further embodiments, with the provision that the bosses 126 and flanges 128 secure the pin plate 110 to strap 108 through openings 116. Additionally, while two bosses 126 and openings 116 are shown, it is understood that a single boss may fit through a single opening 116 to affix the pin plate 110 to the strap 108.

As noted above, strap 108 may be affixed to the central piece 104 with either side of strap 108 facing upward. Accordingly, both sides of strap 108 may include the recess 132 so that the pin plate 110 may be affixed to either side of strap 108. It is understood that the recess may be omitted from one side of strap 108, or from both sides of the strap 108, in further embodiments.

With the pin plate 110 secured to the strap 108, the pins 120 may extend through fastening holes 114 to secure the strap 106 to the pin plate 110 and strap 108. As noted above, while pins 120 and fastening holes 114 are shown as circular and as being a pair, the pins 120 and fastening holes 114 can be other shapes, and a single pin 120 may mate within a single fastening hole 114 instead of being in pairs. In an embodiment described above, the pair of bosses 126 are replaced by a single boss 126 fitting through a single opening 116. In such an embodiment, there may be a pair of pins 120 mounted on a single boss 126, or a single pin 120 mounted on a single boss 126.

As noted in the Background section, fastening a device 100 using pins within fastening holes has a shortcoming in that a wearer is only able to adjust the fit of the device on his or her wrist by the pitch P between the fastening holes. In accordance with the present technology, depending on the orientation of the pin plate 110 on strap 108, a wearer is able to adjust the fit of the device on his or her wrist by one half the pitch, P/2, between fastening holes.

Referring now to FIG. 9, as indicated above, the pin plate 110 mates to first or second surfaces of strap 108 as indicated by arrow A. In addition, the pin plate 110 may be mated to the strap 108 with an edge 110*a* adjacent an edge 108*b* of strap 108, or the pin plate 110 to be rotated 180° as indicated by arrow B, and mated to the plate 110 with an edge 110*b* adjacent the edge 108*b* of strap 108.

Figure 10:
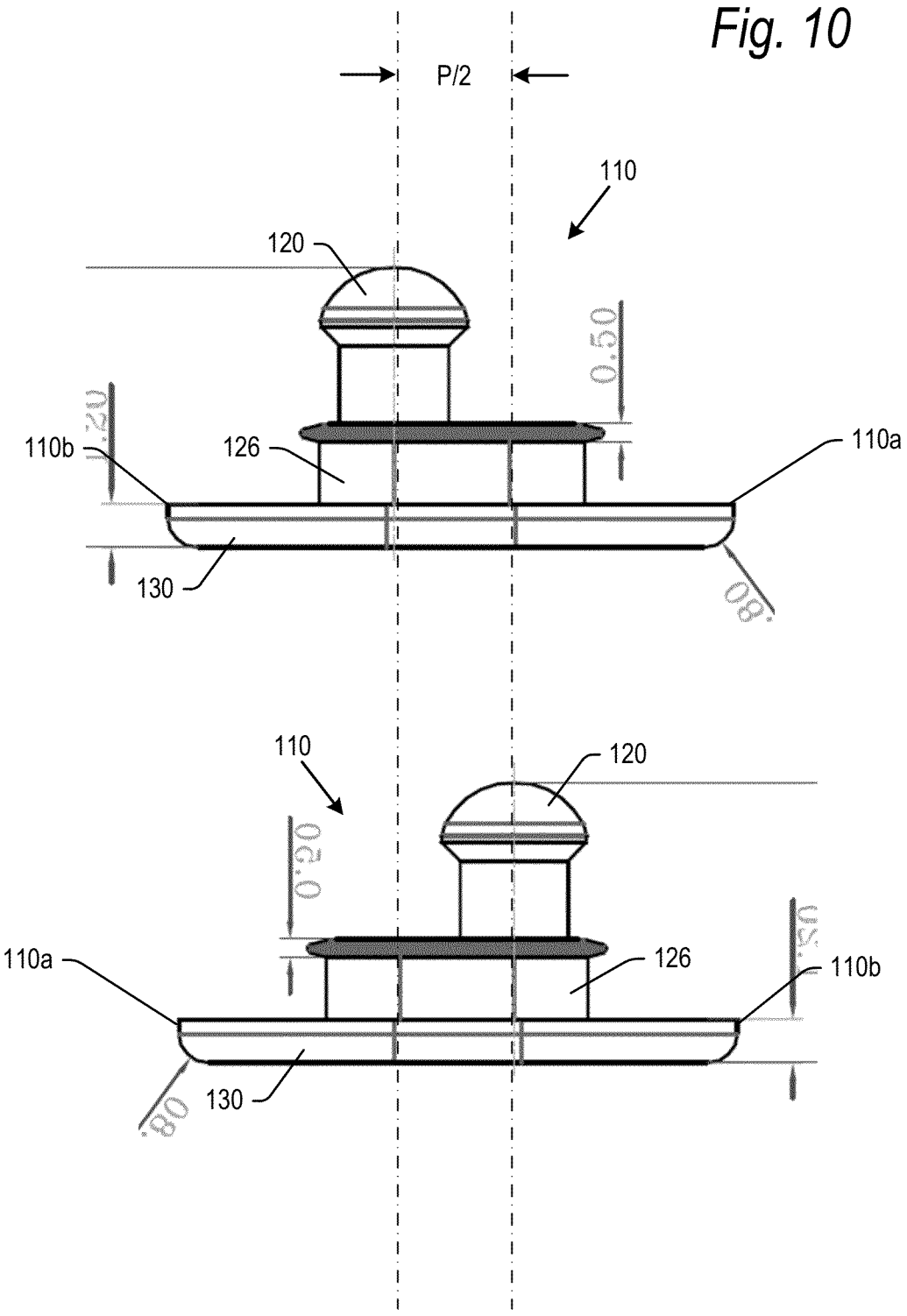
FIG. 10 is an edge view of the pin plate in a first orientation and the pin plate in a second orientation rotated 180° from the first orientation.

Referring now to FIG. 10, the effect of mating the pin plate 110 to the strap 108 in one orientation versus the other orientation rotated 180° is to shift the position of the pair of pins by one half of the pitch (P/2) in the strap 108. In particular, as seen for example in FIGS. 5 and 6, the pins 120 are not centered on the base plate 130 or bosses 126 with respect to a lengthwise centerline 140 (which is oriented across the width of the strap 108 when pin plate 110 is affixed to strap 108). The pins 120 are however equidistant from a widthwise centerline 144. The net effect is that the pins 120 may be rotated 180° and the respective pins 120 will remain equidistant about widthwise centerline 144, but their position will flip with respect to lengthwise centerline 140.

With pin plate 110 according to the present technology, if a wearer desires to adjust the device 100 to a size around his or her wrist (or other body part) that is in between adjacent fastening holes 114, the wearer may remove pin plate 110 from strap 108, rotate it 180°, and reinsert the pin plate 110 into strap 108. As shown in FIG. 10, the result will be to alter the possible sizes of the device 100 by one half of the pitch between the fastening holes 114. Stated another way, by rotating the orientation of the pin plate 110 in the strap 108, a distance between the pin 120 and a proximal end of the strap 108 (connected to the central piece 104) will change by a distance of P/2.

In embodiments, the pins 120 are spaced from the lengthwise centerline 140 (FIG. 6) by a distance so that, when the pin plate 110 is flipped, the position of the pins 120 has adjusted a distance of P/2. It is understood that the pins 120 may be spaced from lengthwise centerline 140 by a greater or smaller distance, so that when flipped, the position of the pins will be adjusted by a distance greater than or lesser than P/2 but still less than the pitch P.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A device for wearing on a body part, the device comprising:

a central piece;

a first strap affixed to a first portion of the central piece, the first strap including a length and a plurality of fastening holes along the length;

a second strap having a proximal end affixed to a second portion of the central piece; and a pin plate removably affixed to the second strap, the pin plate including a pin for mating within a fastening hole of the plurality of fastening holes on the first strap, the pin plate capable of being affixed to the second strap in a first orientation to define a first circumference of the first and second straps together when the pin is affixed within a first hole of the second strap, and the pin plate capable of being affixed to the second strap in a second orientation to define a second circumference of the first and second straps together when the pin is affixed within a second hole of the second strap, the first and second holes being the same or different holes in the second strap and the first and second circumferences necessarily being different from each other.

2. A device as recited in claim 1, wherein the central piece is a monitor from the group consisting of a watch, timer, pulse monitor, pedometer, calorie counter, smart phone, video phone, digital assistant, digital display and/or calculator.

3. A device as recited in claim 1, wherein the central piece is jewelry.

4. A device as recited in claim 1, wherein the first and second orientations differ 180° from each other.

5. A device as recited in claim 1, wherein the pin plate includes a lengthwise centerline oriented across a width of the second strap and dividing a width of the pin plate in half, and a widthwise centerline oriented transverse the lengthwise centerline and dividing a length of the pin plate in half, the pin being off-center from the lengthwise centerline.

6. A device as recited in claim 1, the pin spaced a first spacing from the widthwise centerline.

7. A device as recited in claim 6, wherein the pin plate comprises a first pin, the pin plate further comprising a second pin, spaced a second spacing from the widthwise centerline on a side of the widthwise centerline opposite the first pin, the first and second spacings being equal to each other.

8. A device as recited in claim 7, wherein the first and second pins are equally off-center with respect to the lengthwise centerline.

9. A device as recited in claim 1, wherein the second strap includes first and second surfaces, the pin plate capable of affixing to either the first or second surface.

* * * * *